US006564687B2

(12) United States Patent
Poole

(10) Patent No.: US 6,564,687 B2
(45) Date of Patent: May 20, 2003

(54) NON-LETHAL PERSONAL DEFENSE DEVICE

(75) Inventor: Trent A. Poole, South Amherst, MA (US)

(73) Assignee: Non-Lethal Defense, Inc., Canterbury, NH (US)

( * ) Notice: Subject to any disclaimer, the term of this patent is extended or adjusted under 35 U.S.C. 154(b) by 0 days.

(21) Appl. No.: 10/184,538

(22) Filed: Jun. 28, 2002

(65) Prior Publication Data

US 2003/0056638 A1 Mar. 27, 2003

Related U.S. Application Data

(62) Division of application No. 09/750,950, filed on Feb. 28, 2000, now Pat. No. 6,431,044, which is a division of application No. 09/322,429, filed on May 28, 1999, now Pat. No. 6,237,461.

(51) Int. Cl.[7] ..... B64D 1/04

(52) U.S. Cl. ..... 89/1.11; 89/1.1; 42/84; 42/1.08

(58) Field of Search ..... 89/1.1, 1.11; 42/1.08, 42/84, 106; 109/29

(56) References Cited

U.S. PATENT DOCUMENTS

| | | | | |
|---|---|---|---|---|
| 3,602,399 A | | 8/1971 | Litman et al. | |
| 3,971,292 A | | 7/1976 | Paniagua | |
| 4,611,198 A | | 9/1986 | Levinson et al. | |
| 4,624,389 A | | 11/1986 | Ang | |
| 4,644,845 A | | 2/1987 | Garehime | |
| 4,982,645 A | | 1/1991 | Abboud | |
| 5,000,347 A | | 3/1991 | Tran | |
| 5,034,730 A | | 7/1991 | Lin | |
| 5,103,366 A | | 4/1992 | Battochi | |
| 5,134,730 A | * | 8/1992 | Vandis | 248/345.1 |
| 5,195,448 A | | 3/1993 | Sims | |
| 5,305,370 A | | 4/1994 | Kearns et al. | |
| 5,311,166 A | * | 5/1994 | Frye | 109/20 |
| 5,397,029 A | | 3/1995 | West | |
| 5,402,000 A | * | 3/1995 | Owens, II | 340/426 |
| 5,415,246 A | * | 5/1995 | Cooper | 180/287 |
| 5,416,466 A | | 5/1995 | Malvaso et al. | |
| 5,424,712 A | | 6/1995 | Rosenberger | |
| 5,476,192 A | | 12/1995 | Julinot | |
| 5,509,581 A | | 4/1996 | Parsons | |
| 5,517,180 A | | 5/1996 | Masi et al. | |
| 5,531,344 A | * | 7/1996 | Winner | 222/1 |
| 5,570,817 A | | 11/1996 | Anderson et al. | |
| 5,629,679 A | | 5/1997 | Cranford et al. | |
| 5,685,636 A | * | 11/1997 | German | 361/232 |
| 5,717,379 A | | 2/1998 | Peters | |

(List continued on next page.)

*Primary Examiner*—Michael J. Carone
*Assistant Examiner*—M. Thomson
(74) *Attorney, Agent, or Firm*—Wolf, Greenfield & Sacks, P.C.

(57) ABSTRACT

A non-lethal personal defense device that may be carried by a user includes a housing, a nozzle having a discharge orifice, a control valve coupled to the nozzle, a pressurized source containing a bio-active agent and coupled to the nozzle, a rangefinder for determining a range to a target, a trigger mechanism for activating firing of the device and a firing controller. The firing controller operates the control valve to discharge an aerosol plume of the bio-active agent through the nozzle in response to activation of the trigger mechanism and in response to the range determined by the rangefinder. The nozzle may include a spray orifice for discharging a pulsed aerosol spray plume at relatively long range and a mist orifice for discharging a pulsed mist aerosol plume at relatively short range. The pulse parameters are varied in response to the sensed range to the attacker. The personal defense device may optionally include a one or more cameras and a wireless communication link for transmitting status information, images and audio to a monitoring station.

5 Claims, 12 Drawing Sheets

U.S. PATENT DOCUMENTS 5,747,719 A * 5/1998 Bottesch ..... 340/574
5,787,628 A 8/1998 Teetzel
5,796,330 A * 8/1998 Vinette ..... 109/29
5,819,124 A * 10/1998 Somner et al. ..... 396/263
5,842,601 A 12/1998 Pierpoint
5,921,442 A 7/1999 Keller et al.
5,931,562 A 8/1999 Arato
6,052,051 A * 4/2000 Whalen ..... 222/1
6,094,135 A * 7/2000 Sugimoto et al. ..... 340/425.5
6,272,781 B1 8/2001 Resnick

* cited by examiner

NON-LETHAL PERSONAL DEFENSE DEVICE

CROSS REFERENCE TO RELATED APPLICATIONS

This application is a divisional of pending application Ser. No. 09/750,950 filed Dec. 28, 2000, now U.S. Pat. No. 6,431,044 which is a divisional of application Ser. No. 09/322,429 filed May 28, 1999, now U.S. Pat. No. 6,237, 461.

FIELD OF THE INVENTION

This invention relates to non-lethal personal defense devices and, more particularly, to personal defense devices capable of delivering a precisely-controlled aerosol plume that is capable of effectively and rapidly incapacitating an attacker.

BACKGROUND OF THE INVENTION

In the array of defensive weaponry, there is no viable, safe defensive alternative to the firearm. While society is increasingly reluctant to combat violent behavior with violent countermeasures, this same society demands a greater level of protection against those individuals and groups who actively employ violent means.

The human hesitancy to dispatch a potentially lethal force is a significant cause of violent injury to police in the line of duty. A police officer may be left without an alternative to lethal force, especially when the attacker is closing at speeds sufficient to cover 15 feet in less than a second.

Handheld aerosol devices have been available for many years. However, at present there are no standards for handheld aerosol devices. This has left the commercial marketplace with substandard devices which are incapable of delivering accurate, respirable aerosol doses directly to the lungs or a metered topical spray to the face, skin, eyes, nasal cavity, mouth and throat. Uncertainty as to the effectiveness of these devices results in the tendency to overdose an attacker to insure absolute containment and control.

Prior art handheld aerosol devices typically utilize oleoresin capsicum (OC), commonly known as pepper spray, in an oil-based solution. Standard commercial atomizers do not effectively disperse such solutions into a reliable mist. As a result, most solutions contain about 5% active agent, whereas an optimized solution should be about three times as concentrated. Furthermore, most standard commercial atomizers create droplets that are much too large to be effectively taken deeply into the lung, even though these aerosol devices would have greater effect if targeted for the lungs. The effectiveness of aerosol spray devices is ultimately measured by the delivery of bio-active agents, such as OC aerosols, directly into the lungs at less than 10 micron particle size, which is necessary for inhalation efficacy. The inflammation of the oropharynx, bronchioles, alveolar ducts, and mucus membranes occurs on contact with typical bio-active chemical agents such as OC aerosol. The physiological impact due to lung and respiratory tract inflammation immediately pulls blood flow from the body's extremities at rates sufficient to incapacitate continued muscular exertion in most people.

Personal defense devices which utilize an aerosol spray are disclosed, for example, in U.S. Pat. Nos.: 3,602,399 issued Aug. 31, 1971 to Litman et al; U.S. Pat. No. 4,624, 389 issued Nov. 25, 1986 to Ang; U.S. Pat. No. 5,000,347 issued Mar. 19, 1991 to Tran; U.S. Pat. No. 5,397,029 issued Mar. 14, 1995 to West; U.S. Pat. No. 5,509,581 issued Apr. 23, 1996 to Parsons; and U.S. Pat. No. 5,570,817 issued Nov. 5, 1996 to Anderson et al.

Another type of non-lethal personal defense device involves the application of an electrical shock to the attacker. A device for projecting two continuous parallel streams of conductive fluid is disclosed in U.S. Pat. No. 3,971,292 issued Jul. 27, 1976 to Paniagua. The streams of fluid are held at different electric potentials so that when they impact a target, an electric circuit is completed, thereby causing a current to pass through the target.

All known prior art non-lethal defense devices have had one or more drawbacks, including but not limited to lack of effectiveness in incapacitating the attacker, difficulty in use under highly stressful conditions, risk of serious injury or death to the attacker and lack of reliability. Accordingly, there is a need for improved non-lethal personal defense devices.

SUMMARY OF THE INVENTION

According to a first aspect of the invention, a personal defense device that may be carried by a user is provided. The device comprises a housing, a nozzle having a discharge orifice, a control valve coupled to the nozzle, a pressurized source containing a bio-active agent and coupled to the nozzle, a rangefinder for determining a range to a target, a trigger mechanism for activating firing of the device and a firing controller. The firing controller is responsive to activation of the trigger mechanism and to the range to the target determined by the rangefinder for operating the control valve to discharge an aerosol plume of the bio-active agent through the nozzle.

In one embodiment, the discharge orifice of the nozzle may comprise a mist orifice for discharging a pulsed mist aerosol plume and a spray orifice for discharging a pulsed spray aerosol plume. The pulsed mist aerosol plume may be utilized when the range to the target is relatively short, and the pulsed spray aerosol plume may be utilized when the range to the target is relatively long.

The control valve may be implemented as a rotary nozzle and a nozzle drive mechanism. The rotary nozzle is rotatable between a mist position wherein the mist orifice is connected to the source, a spray position wherein the spray orifice is connected to the active agent source, and an off position. The nozzle drive mechanism rotates the rotary nozzle to and between the mist position, the spray position and the off position in response to the firing controller. The firing controller may include means for automatically operating the control valve to switch between the mist orifice and the spray orifice in response to variation of the range to the target.

In another embodiment, the source comprises a first container with a bio-active agent and a propellant that are optimized for producing a spray aerosol plume and a second container with a bio-active agent and a propellant that are optimized for producing a mist aerosol plume. The firing controller comprises means for selectively operating the control valve to connect the first container to the spray orifice or to connect the second container to the mist orifice.

The firing controller may include means for automatically operating the control valve to switch between the mist orifice and the spray orifice in response to variation of the range to the target. The firing controller may also include means for varying a pulse width of the pulsed spray aerosol plume when the spray orifice is connected to the source and means for varying the pulse width of the pulsed mist aerosol plume when the mist orifice is connected to the source.

According to a feature of the invention, the device may include means for determining a velocity of the target from sensed range values, and the firing controller operates the control valve in response to the determined velocity. According to another feature of the invention, the device may include means for determining an acceleration of the target from sensed range values, and the firing controller operates the control valve in response to the determined acceleration. Thus, the firing controller may operate the control valve and thereby control the aerosol plume in response to sensed range, velocity, acceleration and/or any other parameter of interest.

In a further embodiment, the discharge orifice of the nozzle may comprise first and second spray orifices for discharging first and second spray aerosol plumes, respectively, that are capable of conducting an electrical current. The device may further comprise a high voltage generator coupled to the first and second spray orifices for applying a high voltage between the first and second spray aerosol plumes. When the device includes a high voltage generator, tactile electrodes may be provided on the device for applying a high voltage shock in the event of physical contact with an attacker.

The personal defense device may include a heater for heating the source. The device may further include a temperature sensor for sensing the temperature of the source and means for energizing the heater when the sensed temperature is less than a predetermined value. A pressure sensor may be utilized for sensing the pressure in the source. If the pressure is insufficient for operation of the device, an indicator or alarm may be activated.

According to another feature of the invention, the personal defense device may include a security device for preventing use by unauthorized persons. Operation of the device may be inhibited unless a predetermined input, such as an identification code or a known fingerprint, is received.

According to another feature of the invention, the personal defense device may include a display for displaying status information relating to the operation of the personal defense device. The display may be optionally configured for displaying images.

According to a further feature of the invention, the personal defense device may include a wind sensor coupled to the firing controller for sensing wind direction and speed. The firing controller may include means for compensating the aerosol plume discharged by the device for sensed wind direction and speed.

The personal defense device may further include a manual override mechanism for discharging an aerosol plume in response to activation of the trigger mechanism, independently of the nozzle, the control valve, the rangefinder and the firing controller.

According to a further feature of the invention, the personal defense device may be provided with one or more cameras, including a forward camera for obtaining an image of the target and a rear camera for obtaining an image of the user. The cameras may be equipped with microphones, so that audio as well as images can be acquired. The cameras may be activated by the trigger mechanism. Images of the target and of the user, and audio, may be stored in the personal defense device and/or transmitted to a monitoring station. The device may include an illuminator for each camera. The target illuminator may be caused to flicker so as to confuse and disorient the attacker. The target illuminator may also be utilized to assist in aiming the personal defense device at the attacker.

The personal defense device may include a wireless communication link for exchanging information with one or more monitoring stations. The device may transmit a user identification, a time and a date to the monitoring station. The personal defense device may include a system for establishing location, either independently or in conjunction with an external network based system. In such case, the device may also include means for transmitting location information directly or transmitting/receiving data to be used in establishing location as part of a network based system. In addition, status information and/or images and audio acquired by the cameras may be transmitted to the monitoring station on the wireless communication link. The personal defense device may operate with a local monitoring station and/or a remote monitoring station.

The trigger mechanism may activate different operating modes, including a ready mode and a fire mode. In the ready mode, the rangefinder, the cameras and all other sensors are activated and information, including images and audio, may be transmitted to the monitoring station. In the fire mode, all sensors continue to operate, and information is transmitted to the monitoring station with an increased level of priority indicated. In addition, the feedback control loop operates the control valve to discharge an aerosol plume in response to the sensed range and other parameters of interest. The high voltage generator, if present in the personal defense device, is activated in the fire mode.

According to another aspect of the invention, a security system is provided. The security system comprises a personal defense device as described above, a gimbal assembly for mounting the personal defense device in a selected location, and a monitoring station for controlling the gimbal assembly and the personal defense device. The gimbal assembly includes means for rotating and tilting the personal defense device for remote surveillance of a specific area and for firing of the device on demand, either manually or automatically.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
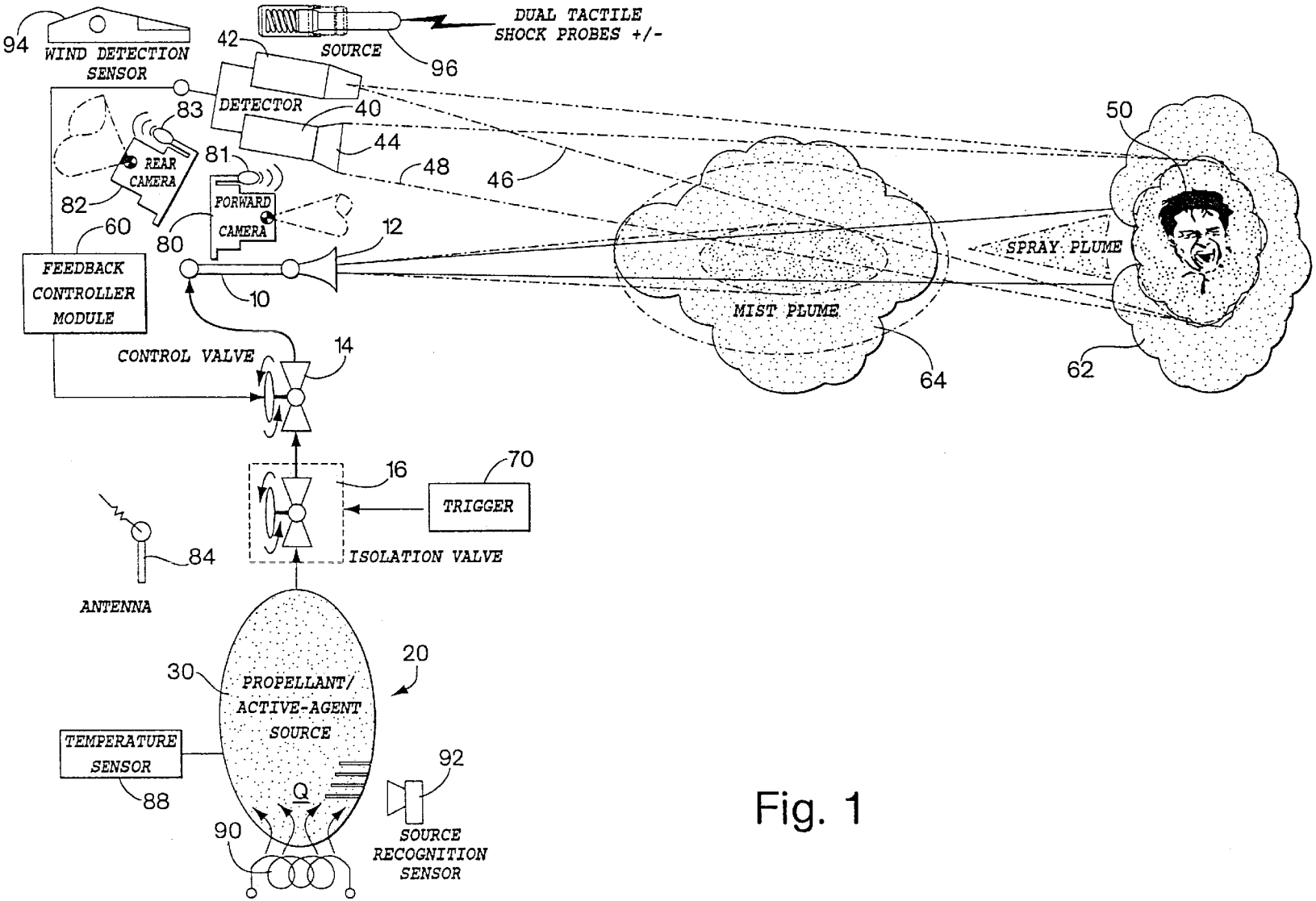
FIG. 1 is a schematic diagram of a non-lethal personal defense device in accordance with a first embodiment of the invention.

A schematic diagram of a non-lethal personal defense device in accordance with a first embodiment of the invention is shown in FIG. 1. A fluid nozzle 10 having an orifice 12 is coupled through a control valve 14 and an isolation valve 16 to an active agent source 20. Active agent source 20 includes a pressurized container 30 which encloses a bio-active chemical agent, such as OC, and a propellant, such as a hydrofluorocarbon or compressed air or nitrogen, selected to produce a desired aerosol plume when discharged through nozzle 10. An aerosol plume is discharged through nozzle 10 when both control valve 14 and isolation valve 16 are opened, as described in detail below. As used herein, "aerosol plume" includes a mist, a spray stream or any other discharge of the bio-active agent from the nozzle of the personal defense device. The active agent source 20 may be provided with a quick disconnect feature to permit use of sources with different parameters and chemical agents, and to permit the device to be reused.

The personal defense device further includes a rangefinder 40 having a source 42 and a detector 44. Rangefinder 40 transmits a beam 46, which may be electromagnetic or acoustic energy, and receives reflected energy 48 for determining the range to an attacker 50. Rangefinder 40 may utilize a sonic or ultrasonic rangefinder, a laser rangefinder, an infrared rangefinder, or an optical/video rangefinder. As described below, rangefinder 40 may also be used to determine the velocity and the acceleration of attacker 50.

A feedback controller 60, or firing controller, controls rangefinder 40 and receives an output signal of detector 44 to determine the range to attacker 50. Feedback controller 60 also controls the operation of control valve 14. In particular, control valve 14 is turned on and off, or pulsed, by feedback controller 60 to produce a desired aerosol plume of the bio-active agent. A spray aerosol plume 62 may be produced when the attacker 50 is at relatively long range, typically 6 feet up to 15 to 20 feet, and a mist aerosol plume 64 may be produced when the attacker 50 is at relatively short range, typically 6 feet or less. The characteristics of the aerosol plume may be controlled by varying the parameters of the pulses applied to control valve 14. Relatively long pulses produce spray plume 62, whereas relatively short pulses produce mist plume 64. Furthermore, the pulses can be modulated on and off at a rapid rate and with a selected duty cycle to control the dose of bio-active agent that is discharged. It will be understood that the pulse parameters can be varied continuously over a range of values, in response to the sensed range and any other parameters of interest, to produce an optimum aerosol plume based on the sensed range to attacker 50. For example, a mist aerosol plume is effective to incapacitate attacker 50 at close range, but is ineffective to incapacitate attacker 50 at longer range. It will be understood that the feedback controller 60 controls the operation of control valve 14 and thereby controls the characteristics of the aerosol plume automatically in response to the sensed range to attacker 50 and any other parameters of interest, as described below. Rangefinder 40, feedback controller 60, control valve 14 and nozzle 10 thus constitute a feedback control loop.

Isolation valve 16, which is connected in series with control valve 14 is controlled by a trigger 70. Trigger 70 is manually operated by a user of the personal defense device in response to a threat by attacker 50. When a threat occurs, the user aims the device so that nozzle 10 and rangefinder 40 are pointed at attacker 50 and activates trigger 70. This permits operation of the feedback control loop including rangefinder 40, feedback controller 60, control valve 14 and nozzle 10 as described above. Trigger 70 can be mechanical or electromechanical. As described below, the trigger may have an off position, a ready position and a fire position.

Several optional enhancements of the personal defense device are shown in FIG. 1. One or more miniature cameras with optional microphones may be utilized. A forward camera 80 with microphone 81 may be pointed in the direction of nozzle 10 in order to obtain images and audio of attacker 50, as well as the local area. A rear camera 82 with microphone 83 may be pointed upwardly and to the rear in order to obtain images and audio of the user. Forward camera 80 may utilize an infinite focus lens, and rear camera 82 may utilize a wide angle lens. The cameras may operate in the visible or near infrared spectral region. Cameras with night vision capability may be utilized.

Cameras 80 and 82 may be activated by trigger 70, in response to a perceived threat to the user. As described below, trigger 70 may activate different operating modes of the personal defense device. For example, a ready trigger position may activate cameras 80 and 82 but not control valve 14, whereas a fire trigger position may activate both cameras 80 and 82 and control valve 14. The images acquired by cameras 80 and 82 may be transmitted via a wireless communication link, including an antenna 84, to a local or remote monitoring station for recording and/or to summon assistance in dealing with attacker 50. In addition, the personal defense device may be provided with a frame memory for storing images obtained by cameras 80 and 82.

Active agent source 20 may be provided with a source temperature sensor 88 and a source heater 90 to ensure that the bio-active agent and propellant in container 30 are maintained at a temperature that is suitable for efficient operation of the device. When the sensed source temperature is below a predetermined value, the source heater 90 may be energized. Active agent source 20 may further include a source recognition sensor 92, such as a bar code reader or a device for reading a memory chip, for sensing the parameters, such as contents, pressure, manufacturing date, etc., of pressurized container 30.

A wind sensor 94 may be mounted on the personal defense device to sense ambient wind direction and speed. The sensed wind direction and speed may be utilized by feedback controller 60 to compensate the parameters of the aerosol plume for wind conditions. For example, a headwind would effectively increase the range to attacker 50 and would require a longer pulse to be applied to control valve 14 to increase the effective range of spray aerosol plume 62. The wind sensor 94 may utilize a two direction hotwire anemometer sensor or a dynamic pressure sensor, for example.

The personal defense device may be provided with tactile electrodes 96, which apply an electrical shock to attacker 50 in the event that attacker 50 comes in physical contract with the device. A high voltage generator (not shown in FIG. 1) provides a high voltage to tactile electrodes 96. The high voltage may be switched to electrodes 96 based on the sensed range to the attacker. For example, electrodes 96 may be energized when the sensed range to the attacker is less than four feet.

Figure 2:
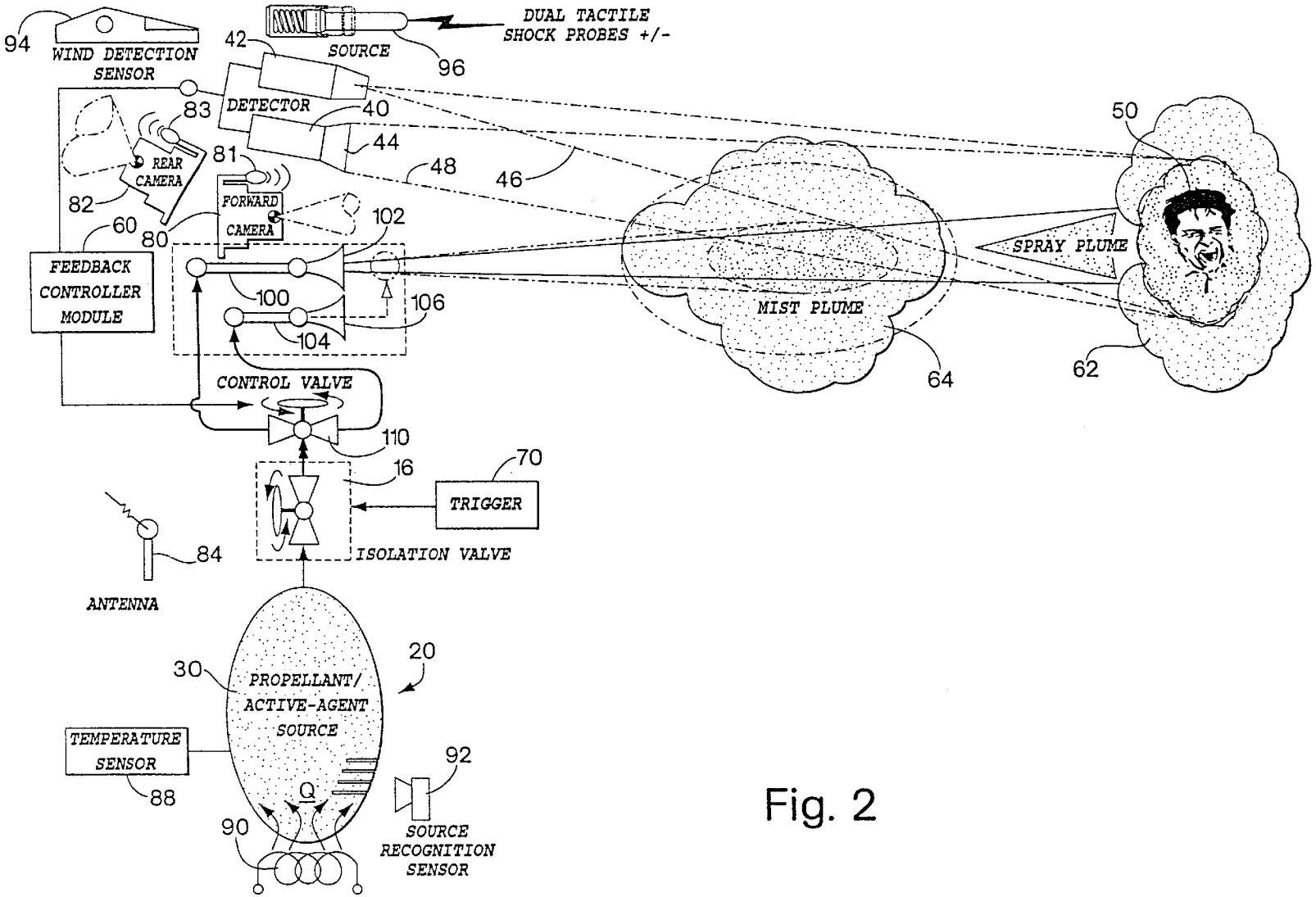
FIG. 2 is a schematic diagram of a non-lethal personal defense device in accordance with a second embodiment of the invention.

A schematic diagram of a second embodiment of a non-lethal personal defense device in accordance with the invention is shown in FIG. 2. Like elements in FIGS. 1 and 2 have the same reference numerals. The personal defense device of FIG. 2 includes a spray nozzle 100 having a spray orifice 102 and a mist nozzle 104 having a mist orifice 106. Spray nozzle 100 is connected to a first output of a control valve 110, and mist nozzle 104 is connected to a second output of control valve 110. An input of control valve 110 is connected through isolation valve 16 to active agent source 20. Control valve 110 is configured to have three positions: an off position, a spray position where the inlet is connected to spray nozzle 100 and a mist position where the inlet is connected to mist nozzle 104. It will be understood that spray nozzle 100 and mist nozzle 104 can be configured as a single nozzle having a spray orifice and a mist orifice.

The operation of control valve 110 is controlled by feedback controller 60 in response to the range determined by rangefinder 40 and any other desired factors. More particularly, when trigger 70 has been activated and rangefinder 40 indicates a relatively long range to attacker 50, typically more than 6 feet, feedback controller 60 operates control valve 110 to provide pulsed aerosol spray plume 62 through spray nozzle 100. The pulse parameters are varied in accordance with the measured range to attacker 50. When the range to attacker 50 is relatively short, typically 6 feet or less, feedback controller 60 operates control valve 110 to discharge pulsed mist aerosol plume 64 through mist nozzle 104. The pulse parameters of mist plume 64 are varied in accordance with the measured range to attacker 50 and any other parameters of interest. The embodiment of FIG. 2 provides the advantage that spray nozzle 100 can be optimized for producing spray aerosol plume 62 and mist nozzle 104 can be optimized for producing mist aerosol plume 64. As a result, the personal defense device operates effectively from short range to long range.

Figure 3:
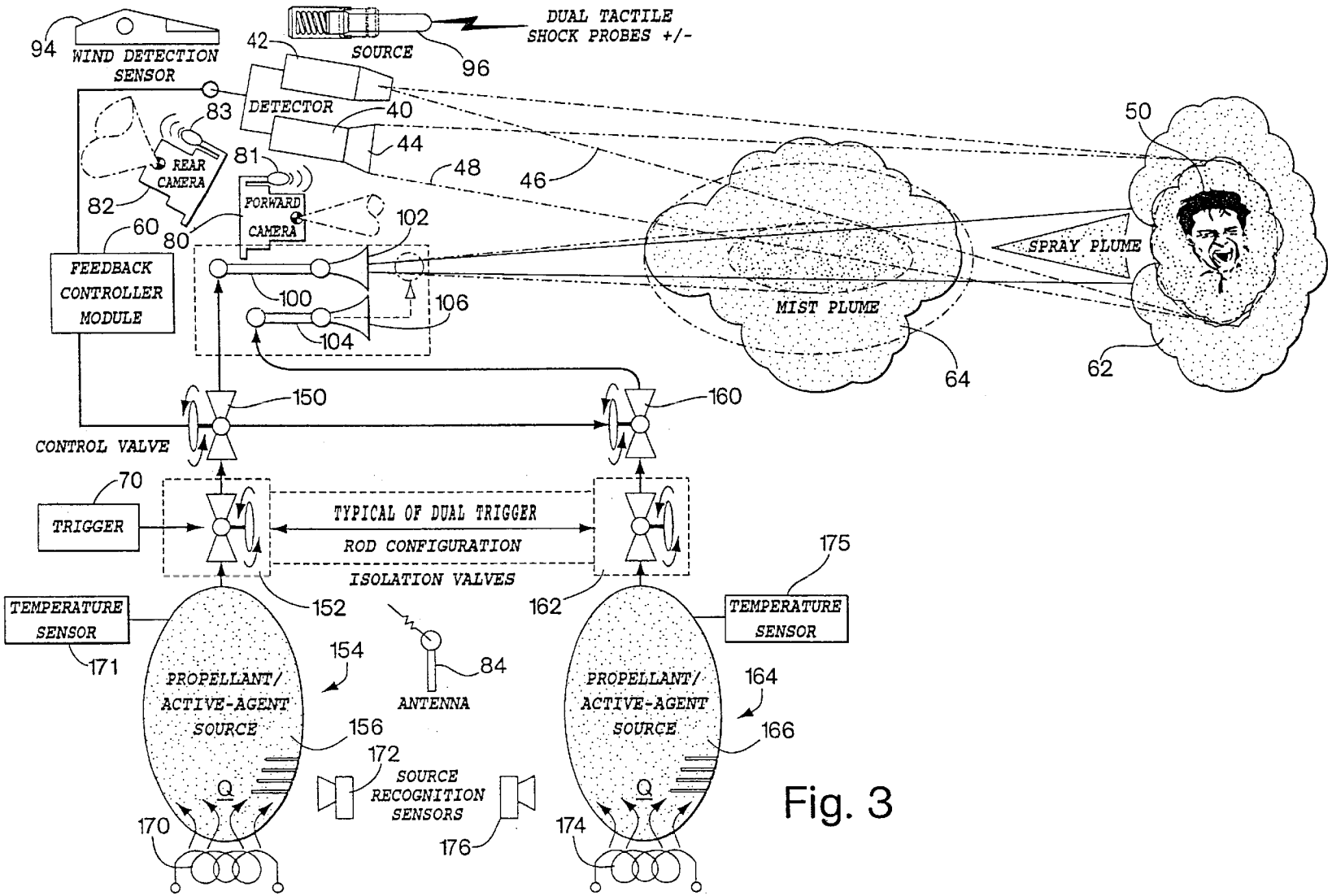
FIG. 3 is a schematic diagram of a non-lethal personal defense device in accordance with a third embodiment of the invention.

A schematic diagram of a third embodiment of a non-lethal personal defense device in accordance with the invention is shown in FIG. 3. Like elements in FIGS. 1–3 have the same reference numerals. The embodiment of FIG. 3 includes spray nozzle 100 and mist nozzle 104. Spray nozzle 100 is coupled through a control valve 150 and an isolation valve 152 to an active agent source 154. Mist nozzle 104 is connected through a control valve 160 and an isolation valve 162 to an active agent source 164. Control valves 150 and 160 are controlled by feedback controller 60. Isolation valves 152 and 162 are controlled by trigger 70. Preferably, isolation valves 152 and 162 are both opened when trigger 70 is activated. As indicated above, nozzles 100 and 104 may be combined in a single nozzle having a spray orifice and a mist orifice.

Active agent source 154 includes a pressurized container 156 that contains a bio-active chemical agent and a propellant, which are selected for efficient production of spray aerosol plume 62. In particular, parameters, such as the bio-active agent composition, the propellant composition, the relative proportions of the bio-active agent and the propellant, and the pressure in container 156, may be selected for efficient production of spray aerosol plume 62. Active agent source 164 includes a pressurized container 166 that contains a bio-active chemical agent and a propellant, which are selected for efficient production of mist aerosol plume 64. Similar to source 154, the source parameters, such as bio-active agent composition, propellant composition, relative proportions of bio-active agent and propellant, and the pressure in container 166, may be selected for efficient production of mist aerosol plume 64.

Active agent source 154 may include a source heater 170 for heating the contents of container 156, a source temperature sensor 171 for sensing the temperature of active agent source 154, and a source recognition sensor 172 for identification of active agent source 154. Similarly, active agent source 164 may include a source heater 174 for heating the contents of container 166, a source temperature sensor 175 for sensing the temperature of active agent source 164, and a source recognition sensor 176 for identification of source 164. Where the active agent sources 154 and 164 are located in close proximity, a single source temperature sensor and a single source heater may be utilized. Where the personal defense device is intended for use in warm climates or where the contents of the active agent source are relatively insensitive to temperature variations, a source temperature sensor and a source heater may not be required.

When trigger 70 is activated by the user, feedback controller 60 operates one of control valves 150 and 160 in accordance with the sensed range to attacker 50, as determined by rangefinder 40. For relatively long ranges, control valve 150 is pulsed to provide spray aerosol plume 62. The pulse parameters may be varied in accordance with the range and any other parameters of interest. When the range to attacker 50 is relatively short, feedback controller 60 operates control valve 160 to discharge pulsed mist aerosol plume 64. The pulse parameters are varied in accordance with the range and any other parameters of interest. Typically, spray aerosol plume 62 has a relatively long pulse duration and pulse mist aerosol plume 64 has a relatively short pulse duration. The range of spray aerosol plume 62 is governed primarily by the size of spray nozzle 100 and the pressure in active agent source 154. Therefore, the ultimate range is nozzle and pressure limited.

The embodiment of FIG. 3 has the advantage that both nozzle 100 and source 154 may be optimized for production of spray aerosol plume 62, and both mist nozzle 104 and source 164 may be optimized for production of mist aerosol plume 64. As a result, the personal defense device operates with a high degree of effectiveness from short range to long range.

Various modifications of the non-lethal personal defense device shown in FIGS. 1–3 and described above are included within the scope of the invention. For example, spray nozzle 100 and mist nozzle 104 may be combined in a single nozzle having a spray orifice and a mist orifice. The defense device may include one or more spray orifices and one or more mist orifices. As described below, two spray orifices may be utilized to facilitate the incorporation of an electroshock feature into the personal defense device. In a further embodiment, a single nozzle 10, as shown in FIG. 1, may be utilized with two active agent sources 154 and 164, as shown in FIG. 3. In yet another embodiment, trigger 70 electronically enables feedback controller 60 when activated and inhibits feedback controller 60 when not activated. In this case, isolation valve 16 may not be required. Other modifications will be apparent to those skilled in the art.

Figure 4:
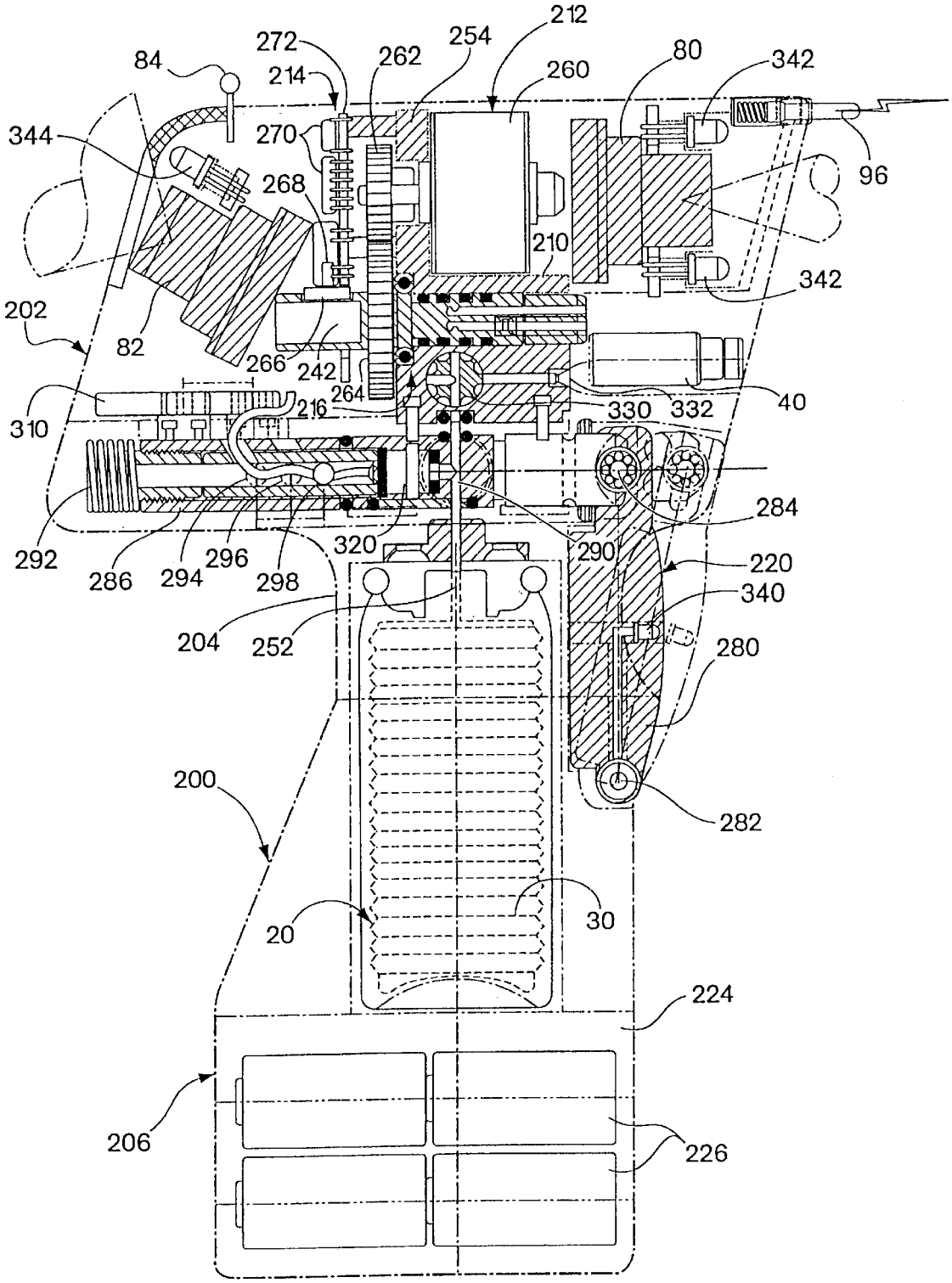
FIG. 4 is a simplified cross-sectional view of a fourth embodiment of a non-lethal personal defense device in accordance with the invention.

A non-lethal personal defense device in accordance with a fourth embodiment of the invention is shown in FIGS. 4, 5, 6A and 6B. Like elements in FIGS. 1–6B have the same reference numerals. The fourth embodiment is an implementation of the personal defense device and is similar to the second embodiment shown in FIG. 2. A housing 200 encloses the components of the personal defense device. The size and weight of the personal defense device permit it to be carried by a user and to be placed, for example, in a pocket or a holster when not in use. Housing 200 includes an upper portion 202, a handle portion 204 and a lower portion 206. By way of example, housing 200 may be fabricated of a rigid, durable plastic material. As shown in FIG. 4, the major components of the personal defense device include a rotary nozzle 210, a control valve actuator 212, a control unit 214, rangefinder 40, forward camera 80, rear camera 82, a manual override valve 216, a trigger assembly 220, active agent source 20 and a battery compartment 224 containing batteries 226. Batteries 226 can be one-time use or rechargeable types.

Figure 5:
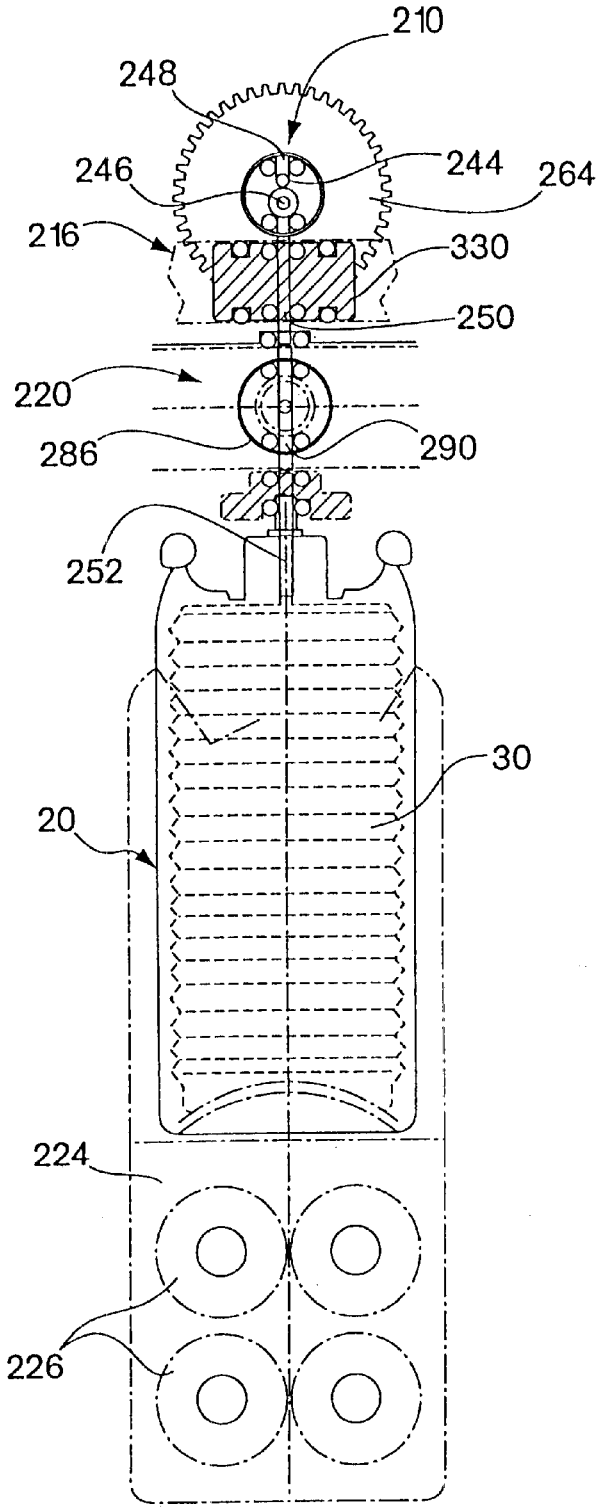
FIG. 5 is a simplified partial cross-sectional view of the fourth embodiment, showing the connection between the active agent source and the nozzle.
Figure 6A:
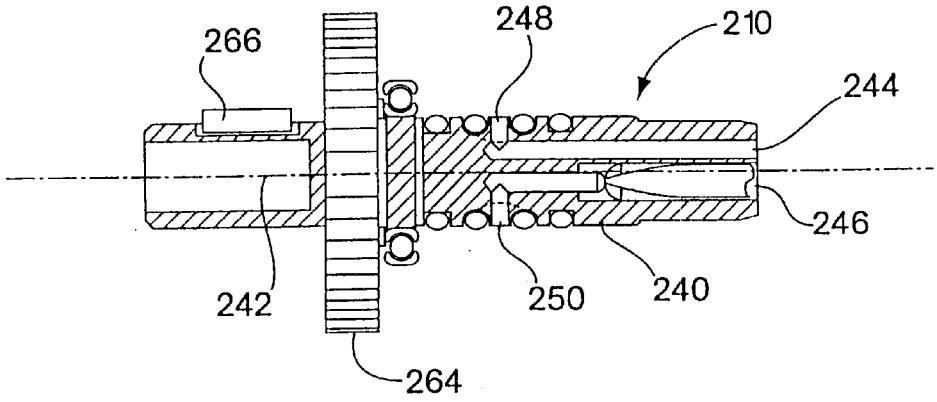
FIG. 6A is a cross-sectional view of the rotary nozzle in the fourth embodiment.

Rotary nozzle 210 combines the functions of spray nozzle 100, mist nozzle 104 and control valve 110 shown in FIG. 2 and described above. Rotary nozzle 210, as best shown in FIG. 6A, includes a generally cylindrical nozzle body 240 that is mounted in a structural block 254 (FIG. 4) and is rotatable about an axis of rotation 242. Nozzle body 240 defines a spray orifice 244 connected to a radial passage 248 and a mist orifice 246 connected to a radial passage 250. As shown in FIGS. 4 and 5, a passage 252 connects active agent source 20 to nozzle 210 when trigger assembly 220 is activated and manual override valve 216 is in the normal position. By rotating nozzle 210 to a spray position wherein radial passage 248 is aligned with passage 252, spray orifice 244 is connected to active agent source 20, and a spray aerosol plume is discharged through spray orifice 244. By rotating nozzle 210 to a mist position wherein radial passage 250 is aligned with passage 252, mist orifice 246 is connected to active agent source 20, and a mist aerosol plume is discharged through mist orifice 246. When neither of radial passages 248, 250 is aligned with passage 252, nozzle 210 is in an off state, and no aerosol plume is discharged. Thus, rotation of nozzle 210 corresponds to actuation of control valve 110 shown in FIG. 2.

The rotary nozzle 210 may be designed for discharging an aerosol plume having particles in a range of about 1–15 micrometers. Typically, particles of 10–13 micrometers are deposited in the oropharyngeal region, particles of 5–10 micrometers are deposited in the trachea-bronchial region, and particles of 1–5 micrometers are deposited in the deep lung region. The spray orifice 244 is designed as a tube with an optimum length/diameter ratio to maintain the most stable discharge stream length before natural stream breakup due to drag forces on the stream within the ambient air. The mist orifice 246 is a high hydraulic loss nozzle designed to fracture and break up the discharge ligament into small mist droplets. A sharp edge orifice and/or large perimeter orifice, such as a star pattern, is suitable.

The aerosol plume includes a mist and/or spray of the bio-active agent for maximum debilitating effect. The aerosol plume is delivered externally to the skin and eyes as a spray and internally to the pulmonary system, the oropharyngeal region, the trachea-bronchial region and the alveolar regions of the lungs as a mist. The physiological effect of the aerosol plume is the immediate inflammation of the mucus membranes of the lungs and respiratory system, which pulls blood from the body's extremities at rates sufficient to drastically diminish further muscular exertion. The attacker loses muscle control and drops to his knees, coughing, gagging and gasping for breath. In addition, the aerosol plume acts topically on the skin, eyes, nose, mouth and throat, causing a burning sensation to the surface nervous system receptors. The degree of discomfort is based on the chemical concentration of the bio-active agent and the amount applied. The combination of burning skin discomfort, nasal and eye discomfort and oral discomfort immobilizes an attacker while elevating his pulmonary breathing and heart rate.

As indicated above, rotary nozzle 210 may be rotated about axis 242 to an off position, a spray position or a mist position. Together, rotary nozzle 210 and control valve actuator 212 constitute a control valve that corresponds to control valve 110 shown in FIG. 2 and described above. Valve actuator 212, as shown in FIG. 4, includes a motor 260 mounted to structural block 254, a gear 262 attached to motor 260 and a gear 264 attached to rotary nozzle 210. Motor 260 can be a stepper motor, for example. When motor 260 is energized, rotary nozzle 210 is rotated about axis 242 to the spray position, the mist position or the off position. Typically a 10 degree rotation from radial passage 248 or 250 is sufficient to turn nozzle 210 off. By pulsed operation of motor 260 between the spray position or the mist position and the off position, nozzle 210 discharges pulsed spray aerosol plume 62 or pulsed mist aerosol plume 64 (FIG. 2). An electronic position sensor, such as a magnetic element 266 mounted on nozzle body 240 and a magnetic nozzle position sensor 268, mounted in a fixed position to sense magnetic element 266, may be utilized to determine the angular orientation of rotary nozzle 210.

Control unit 214 shown in FIG. 4 may include integrated circuits 270 mounted on a printed circuit board 272. Printed circuit board 272 may be mounted to structural block 254. Magnetic sensor 268 may be mounted on printed circuit board 272. Control unit 214 may include circuitry for controlling operation of the personal defense device, as described below.

Trigger assembly 220 shown in FIG. 4 includes a trigger bar 280 pivotally attached by a pin 282 to housing 200 and pivotally attached by a pin 284 to a firing rod 286. Firing rod 286 has a generally cylindrical configuration and is provided with a radial passage 290. When the trigger assembly 220 is activated to the fire position, passage 290 is aligned with passage 252 and provides a connection between active agent source 20 and rotary nozzle 210. The movement of passage 290 with respect to passage 252 in response to activation of trigger assembly 220 is an implementation of isolation valve 16 shown in FIG. 2 and described above.

Figure 6B:
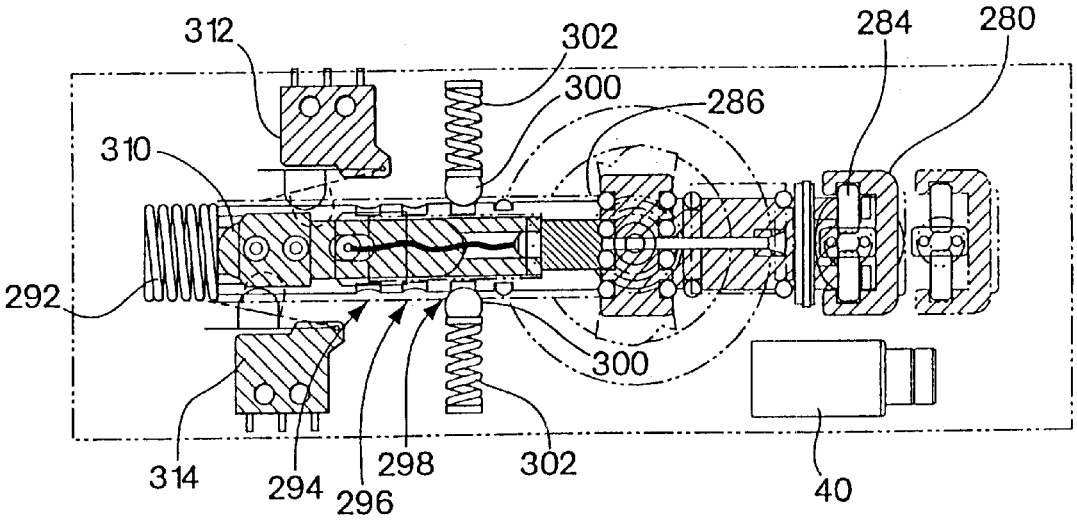
FIG. 6B is a simplified partial cross-sectional view of the fourth embodiment, showing the trigger assembly.

The user activates the trigger assembly 220 by pulling trigger bar 280 inwardly. A spring 292 biases firing rod 286 toward a deactivated, or off, position, shown in phantom in FIG. 4. In a preferred embodiment, trigger assembly 220 has three distinct positions defined by detents 294, 296 and 298 on firing rod 286. As shown in FIG. 6B, a ball 300 is biased against firing rod 286 by a spring 302 on each side of firing rod 286. The balls 300 engage the respective detents as the trigger assembly is activated, thereby providing a positive indication of each position. Detent 294 may correspond to a deactivated, or off, mode; detent 296 may correspond to a ready mode; and detent 298 may correspond to a fire mode. The functions performed by the personal defense device in the ready mode and the fire mode are described below.

In one embodiment, isolation valve 16 (FIG. 2) is open in the ready mode and in the fire mode. In another embodiment, the isolation valve 16 is open only in the fire mode. As stated above, isolation valve 16 may not be required where the trigger electronically enables control unit 214. However, isolation valve 16 permits manual override valve 216 to be incorporated into the personal defense device as described below.

A switching cam 310 may be mounted to firing rod 286. Switching cam 310 is shaped to activate a ready switch 312 when the firing rod 286 is in the ready position and to activate a fire switch 314 when the firing rod 286 is in the fire position. Trigger assembly 220 is further provided with a pressure sensor 320 which is connected to passage 290. Pressure sensor 320 senses the pressure in pressurized container 30 when the device is idle and when it is in use. If the pressure is insufficient for operation, an indicator or alarm may be activated.

An LED 340 may be mounted in trigger bar 280. The LED 340 is pulsed at all times and may be used to locate trigger bar 280 in darkness. LED 340 may serve as an indicator of the operational condition of the personal defense device. When LED 340 is not illuminated, a low battery condition or other malfunction is indicated.

Manual override valve 216 may be utilized in the event that rotary nozzle 210, valve actuator 212 and/or control unit 214 is inoperative. Manual override valve 216 includes a rotatable valve member 330 mounted in structural block 254. Valve member 330 is provided with passages that connect active agent source 20 to nozzle 210 or to an override nozzle 332 in structural block 254. Valve member 330 is rotatable between a normal position, as shown in FIG. 4, and a manual override position, where valve member 330 is rotated by 90 degrees in a counter-clockwise direction from the position shown in FIG. 4. In the normal position, rotary nozzle 210 is connected to active agent source 20 and override nozzle 332 is isolated. In the override position, override nozzle 332 is connected to active agent source 20 and rotary nozzle 210 is isolated. In the override position, override nozzle 332 is connected through valve member 330 to active agent source 20 and rotary nozzle 210 is isolated. Thus, when trigger assembly 220 is activated, an aerosol plume is discharged through override nozzle 332 independently of rotary nozzle 210, valve actuator 212 and control unit 214. Manual override valve may be rotated to the manual override position in the event that the automatic features of rotary nozzle 210, valve actuator 212 and control unit 214 are inoperative. Manual override valve 216 may be spring-loaded to return from the manual override position to the normal position when manually released.

Forward camera 80 is mounted in housing 200 so as to view along the line of sight of nozzle 210 and rangefinder 40. Light sources 342 may be utilized to illuminate a region corresponding to the maximum range of rotary nozzle 210. Rear camera 82 is mounted in housing 200 and is directed upwardly and to the rear so as to obtain an image of the user. A light source 344 may be utilized to provide illumination for rear camera 82. A variety of different light sources, including incandescent, high intensity discharge, laser and LED sources, may be utilized for illumination. Forward light source 342 may be caused to flicker so as to confuse and disorient the attacker. Forward light source 342 may also be utilized to assist in visually aiming the personal defense device.

A non-lethal personal defense device in accordance with a fifth embodiment of the invention is shown in FIGS. 7, 8, 9A and 9B. The fifth embodiment is an implementation of the personal defense device and is similar to the third embodiment shown in FIG. 3 and described above. Like elements in FIGS. 1–9B have the same reference numerals. The fifth embodiment differs from the fourth embodiment with respect to the configuration of the rotary nozzle, the trigger assembly and the active agent source, and the addition of a projected electroshock capability.

Figure 9A:
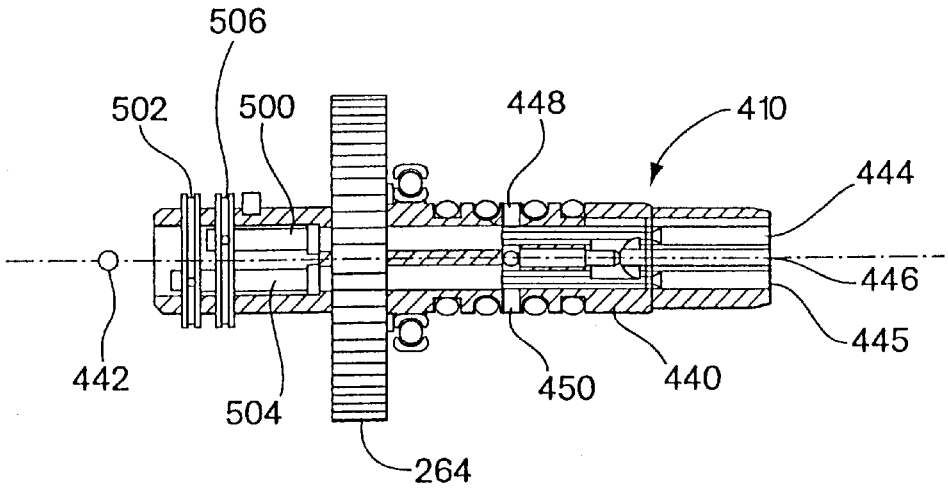
FIG. 9A is a cross-sectional view of the rotary nozzle in the fifth embodiment.

A rotary nozzle 410 combines the functions of spray nozzle 100, mist nozzle 104, and control valves 150 and 160 shown in FIG. 3 and described above. Rotary nozzle 410, as best shown in FIG. 9A, includes a generally cylindrical nozzle body 440 that is rotatable about an axis 442. Nozzle body 440 defines first and second spray orifices 444 and 445 connected to a radial passage 448 and a mist orifice 446 connected to a radial passage 450.

Figure 7:
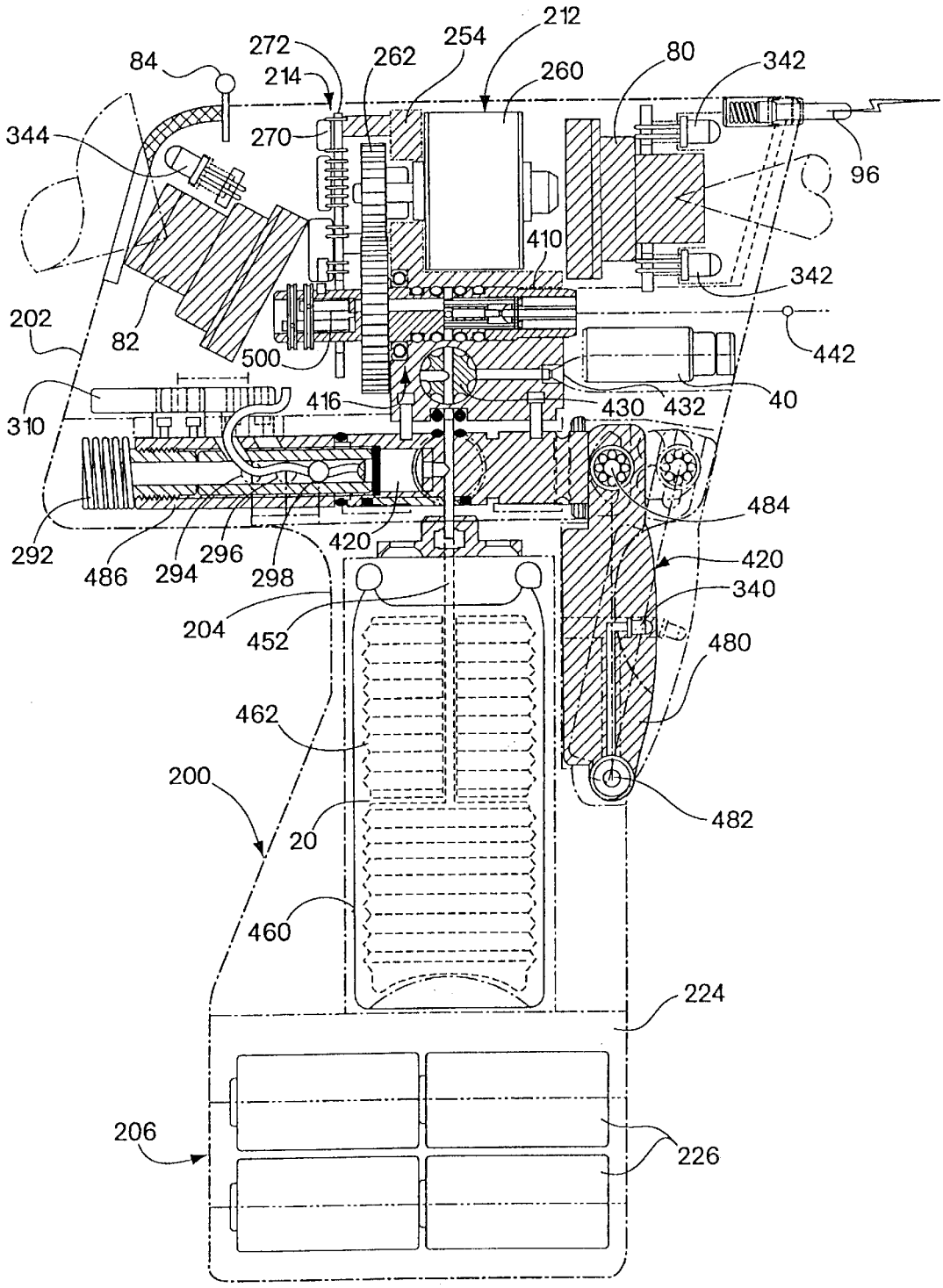
FIG. 7 is a simplified cross-sectional view of a non-lethal personal defense device in accordance with a fifth embodiment of the invention.
Figure 8:
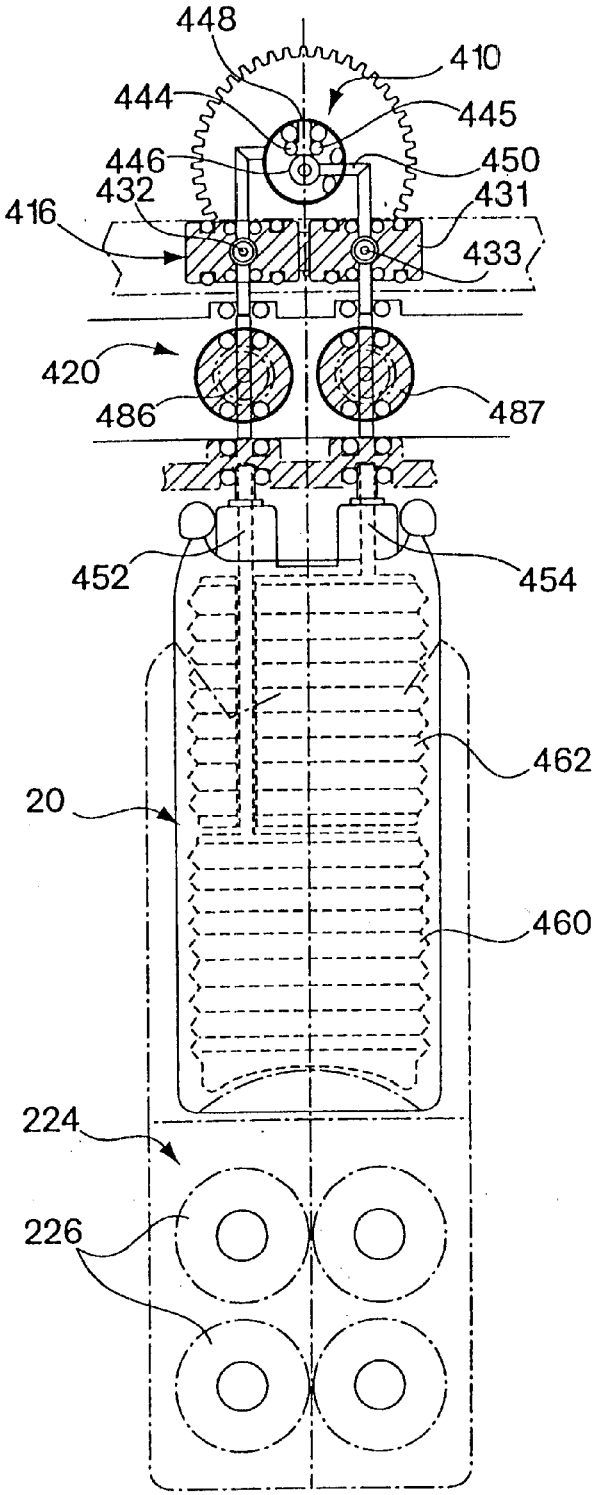
FIG. 8 is a simplified partial cross-sectional view of the fifth embodiment, showing the connections between the active agent source and the nozzle.

Active agent source 20, as best shown in FIGS. 7 and 8, includes a first pressurized container 460 and a second active agent container 462. As described below, a manual override valve 416 includes dual valve members 430 and 431, and a trigger assembly 420 includes dual firing rods 486 and 487.

As best shown in FIG. 8, pressurized container 462 may be connected through a passage 454 and radial passage 450 in nozzle 410 to mist orifice 446. The parameters of pressurized container 462, including for example bio-active agent composition, propellant composition, relative proportions of active agent and propellant, and pressure, may be optimized for producing a mist aerosol plume. By rotating nozzle 410 such that passage 452 is aligned with radial passage 448, pressurized container 460 may be connected to first and second spray orifices 444 and 445. The parameters of pressurized container 460 may be optimized for producing a spray aerosol plume. Valve actuator 212 may rotate nozzle 410 between an off position, a mist position where mist orifice 446 is connected to pressurized container 462 and a spray position where spray orifices 444 and 445 are connected to pressurized container 460. As described above, pulsed operation of valve actuator 212 produces spray aerosol plume 62 or mist aerosol plume 64 (FIG. 3).

Figure 9B:
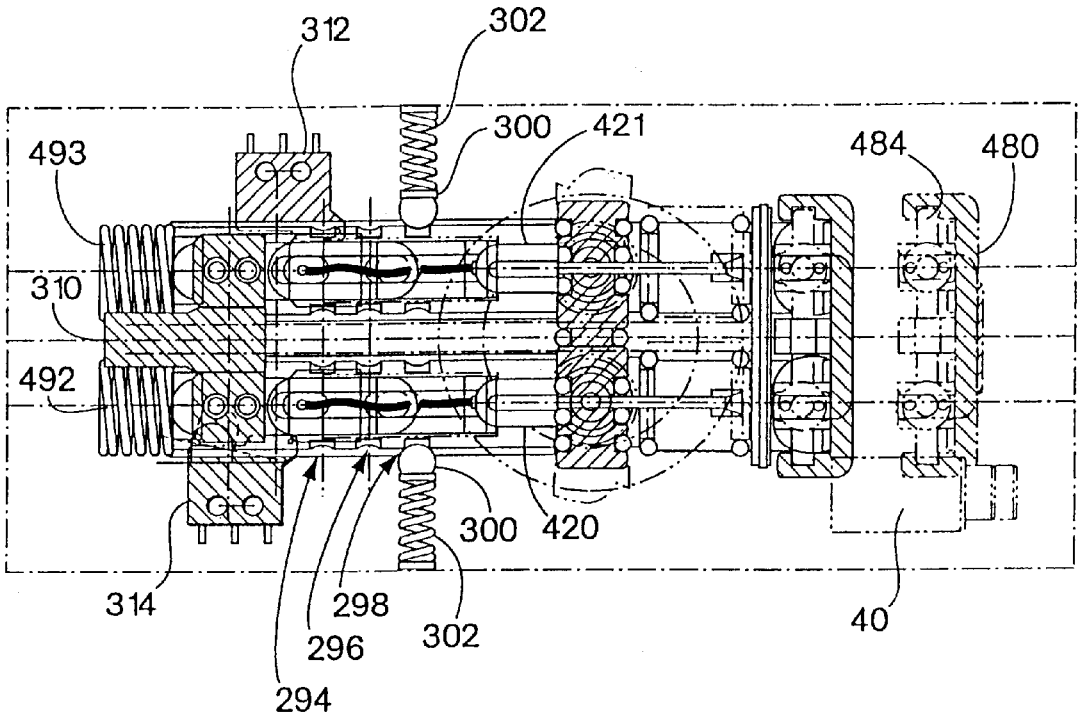
FIG. 9B is a simplified partial cross-sectional view of the fifth embodiment, showing the trigger assembly.

Trigger mechanism 420, best shown in FIGS. 7 and 9B, includes a trigger bar 480 pivotally connected by a pin 482 to housing 200 and pivotally connected by a pin 484 to dual firing rods 486 and 487. Firing rods 486 and 487 are biased to the off position by springs 492 and 493, respectively (FIG. 9B). Each of the firing rods 486 and 487 includes detent 294, which indicates the off position, detent 296, which indicates the ready position, and detent 298, which indicates the fire position. Balls 300 are urged into engagement with detents 294, 296 and 298 on each of firing rods 486 and 487 by springs 302. Switching cam 310, affixed to firing rods 486 and 487, activates ready switch 312 and fire switch 314 as described above in connection with FIG. 6B. A pressure sensor 420 mounted in firing rod 486 senses the pressure in pressurized container 460, and a pressure sensor 421 mounted in firing rod 487 senses the pressure in pressurized container 462.

Manual override valve 416, best shown in FIGS. 7 and 8, includes valve member 430, connected by passage 452 to pressurized container 460, and valve member 431, connected by passage 454 to pressurized container 462. The manual override valve 416 has a normal position, in which pressurized containers 460 and 462 are connected to rotary nozzle 410, and a manual override position, in which pressurized containers 460 and 462 are connected to override nozzles 432 and 433, respectively. Manual override valve 416 may be rotated to the manual override position when rotary nozzle 410, valve actuator 212 and/or control unit 214 malfunction. Manual override valve 416 may be spring-loaded to return from the manual override position to the normal position when manually released.

The personal defense device shown in FIGS. 7–9B includes a projected electroshock feature. As shown in FIG.

Figure 10:
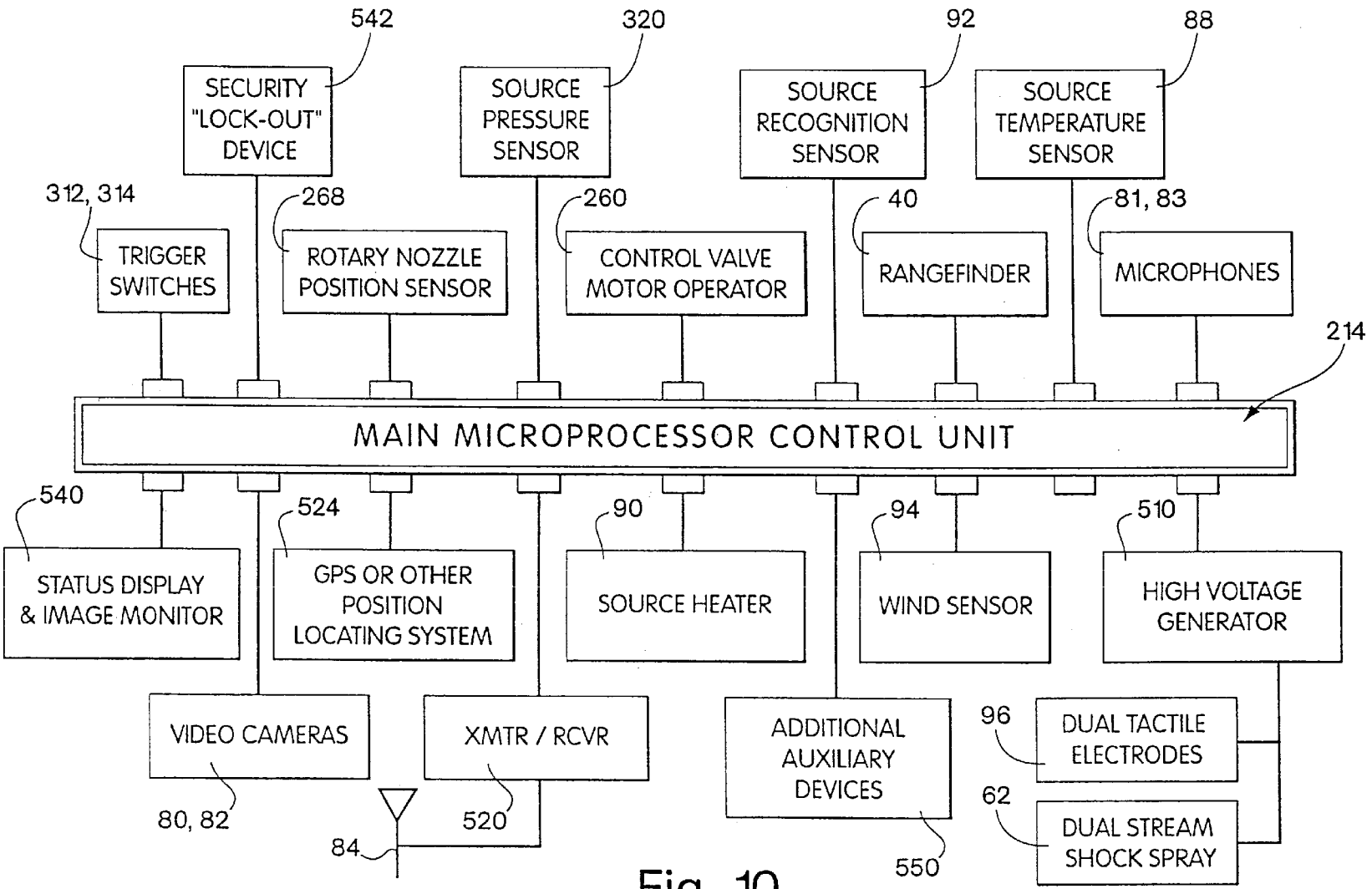
FIG. 10 is a block diagram of a non-lethal personal defense device in accordance with the invention.

9A, spray orifice 444 is electrically coupled by an electrode 500 to a commutator ring 502 mounted on nozzle body 440, and spray orifice 445 is electrically coupled by an electrode 504 to a commutator ring 506 mounted on nozzle body 440. Commutator rings 502 and 506 are connected to the outputs of a high voltage generator 510 (FIG. 10). When high voltage generator 510 is energized and nozzle 410 is discharging spray aerosol plumes through spray orifices 444 and 445, a high voltage is applied between the two spray aerosol plumes, thereby producing positive and negative spray aerosol plumes. The positive and negative spray aerosol plumes must be at least semi-continuous and coherent for the high voltage to be conducted through the liquid medium. When the positive and negative spray aerosol plumes contact an attacker, a high voltage shock is transmitted to the attacker. The combination of the bio-active agent aerosol plume and the high voltage shock are highly effective in incapacitating the attacker.

The control unit 214 may switch the high voltage generator from commutator rings 502 and 506 on nozzle body 440 to tactile electrodes 96 as the sensed range to the attacker decreases. Thus, when the sensed range to the attacker is less than a predetermined value, such as four feet, the high voltage generator 510 is switched from commutator rings 502 and 506 to tactile electrodes 96.

A schematic block diagram of a personal defense device in accordance with the invention is shown in FIG. 10. Control unit 214 receives range signals from rangefinder 40, control valve position signals from nozzle position sensor 268 and wind speed and direction signals from wind sensor 94, and supplies motor control signals to control valve motor 260. Control valve motor 260 controls pulsed operation of the rotary nozzle in response to the sensed range to the target and any other parameters of interest. For example, control unit 214 may modify the pulsed operation of control valve motor 260 in response to the sensed wind direction and speed. In addition, control unit 214 may calculate the velocity and/or acceleration of the attacker from a series of sensed range values and modify the pulsed operation of control valve 260 in response to the calculated velocity and/or acceleration. For example, the aerosol plume dose may be increased if the attacker is closing rapidly (high velocity and/or high acceleration). Thus, control unit 214 performs the functions of feedback controller 60 shown in FIGS. 1–3 and described above. The pulse parameters supplied to control valve motor 260 may be varied in response to the sensed range and other parameters of interest.

The operating state of the personal defense device is controlled in response to signals received by control unit 214 from trigger switches 312 and 314. As indicated above, the personal defense device may have an off mode, a ready mode and a fire mode. In the off mode when the trigger bar is not pulled by the user, the elements of the device are inactive. In the ready mode, initiated by switch 312, the elements of the personal defense device, except control valve motor 260, are activated. Thus, rangefinder 40 is activated and the range to the attacker is determined. Forward camera 80 and rear camera 82 and microphones 81 and 83 are activated and may transmit images and audio via transmitter/receiver 520 and antenna 84. In addition, the location of the personal defense device may be determined by an on board or hybrid network based positioning system 524, and the location coordinates and/or other associated data may be transmitted, with a user identification, the date and the time of day, via transmitter/receiver 520. By way of example, positioning system 524 may be a global positioning system (GPS). Any sensors required for operation of the personal defense device are activated in the ready mode.

When the trigger is activated to the fire mode, the control valve motor 260 is energized in accordance with the determined range and any other desired factors, so as to discharge an aerosol plume. In addition, if the personal defense device is equipped with the electroshock feature, the high voltage generator 510 is activated, and a high voltage is applied to the dual spray aerosol plumes 62 and/or the tactile electrodes 96. The elements that were activated in the ready mode remain in operation during the fire mode.

Control unit 214 may control various aspects of the active agent source. In particular, the control unit receives signals from source pressure sensor 320, source recognition sensor 92 and source temperature sensor 88. If the source temperature is below a predetermined value, source heater 90 may be energized. Source recognition sensor 92 provides control unit 214 with identifying information as to the active agent source. Source pressure sensor 320 indicates whether the source container has sufficient pressure for operation of the personal defense device.

The personal defense device may be provided with a status display 540 in the form of one or more indicator lamps or LED's, a liquid crystal display or other display device known to those skilled in the art. Status information is provided to status display 540 by control unit 214. Display 540 may be configured for displaying alphanumeric information and/or images.

The personal defense device may include a security device 542 which prevents use by unauthorized persons and inhibits operation until a user code or other identification is entered. Examples of suitable security devices include, but are not limited to, security code modules, fingerprint recognition modules, voice recognition modules, remote control modules, time-based security modules, and the like.

Control unit 214 may be implemented as a programmed microprocessor including suitable RAM and/or ROM for program storage, and interface circuits for interfacing with the devices shown in FIG. 10 and described above. The microprocessor is programed to implement feedback control of the control valve and nozzle, to control the high voltage generator 510, to control operation of the active agent source, to control operation of cameras 80 and 82 and microphones 81 and 83, to control transmission of information to a remote location, and to control all other operations of the personal defense device. Control unit 214 may incorporate power control and system diagnostic modules. Additional auxiliary devices 550 may be incorporated into the personal defense device as required by particular applications.

Figure 11:
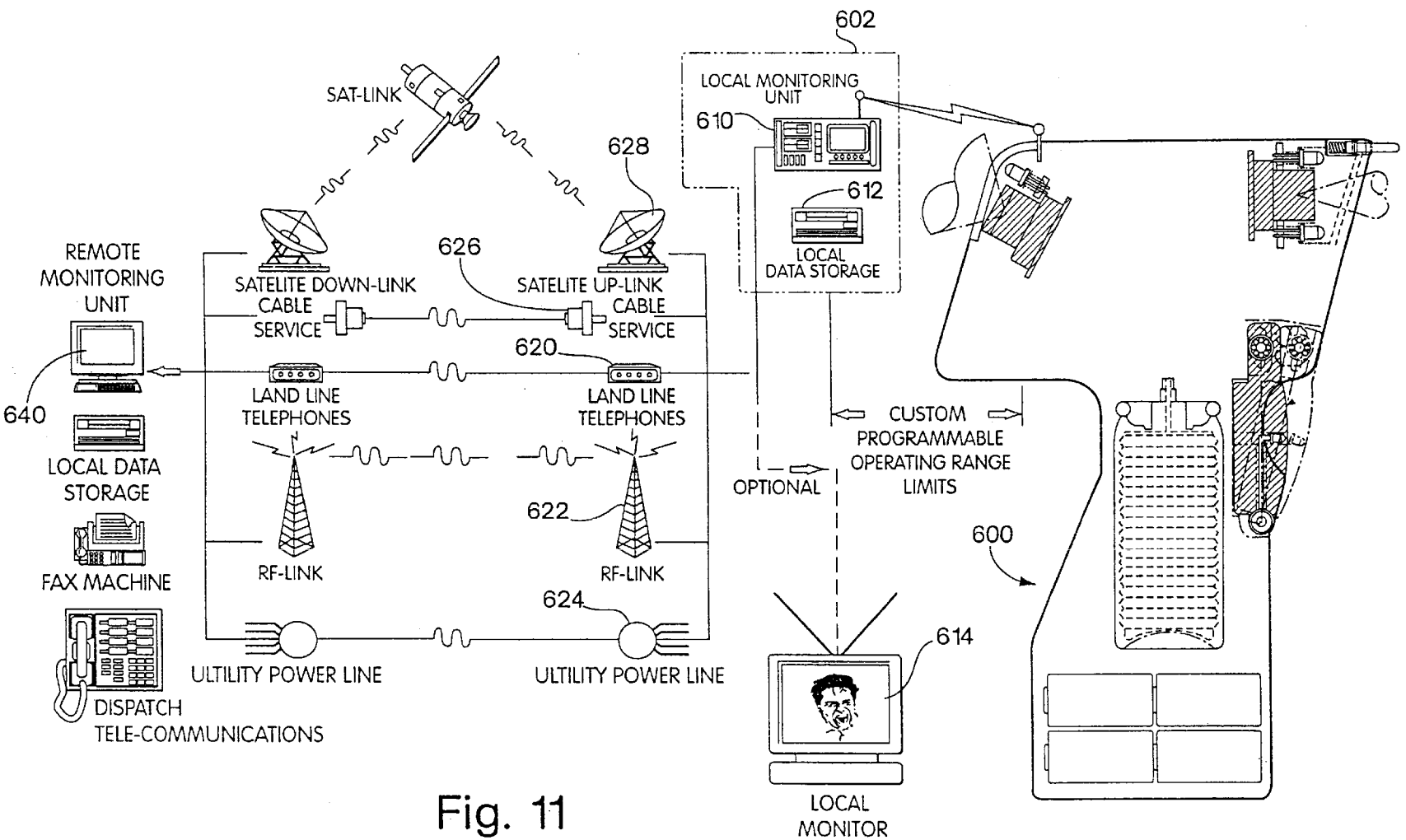
FIG. 11 is a schematic diagram of an embodiment of a communication system incorporating a non-lethal personal defense device and utilizing a wireless communication link.

The personal defense device of the present invention may include a wireless communication link, as illustrated in the system block diagram of FIG. 11. A personal defense device 600 may utilize transmitter/receiver 520 (FIG. 10) for wireless communication with a remote monitoring station 640, either directly on the wireless communication link and/or indirectly via a local monitoring unit 602. Local monitoring unit 602 may include a local transceiver 610 and a local data storage unit 612, such as a hard disk drive, and may display information on a local monitor 614. The local monitoring unit 602 may communicate via any suitable communication link, such as a land line telephone 620, an RF link 622, a utility power line link 624, a TV cable link 626, a satellite link 628 or the like, with remote monitoring station 640.

The local monitoring unit 602 is a communication manager that receives a local transmission from one or more personal defense devices and retransmits the information to the remote monitoring station 640. The information may also be stored in local data storage unit 612. The local monitoring unit 602 may be concealed on site and provided with line and battery backup power. An attacker would not be able to find and disable the local monitoring unit 602 in sufficient time to prevent transmission of information concerning an attack. In addition to permanent locations, such as homes and businesses, the local monitoring unit 602 may be adapted for use in motor vehicles 642 (FIG. 12), ships and other mobile applications. In configurations where the transmitter/receiver 520 has the capability, personal defense device 600 may communicate with the remote monitoring station 640 directly via the wireless communication link.

In use, several levels of information may be transmitted by the personal defense device. The information is typically transmitted when the user activates the ready mode, and transmission continues in the event that the user activates the firing mode. In a first level transmission, an information packet may include a user identification, location coordinates and/or other associated data from positioning system 524 (FIG. 10) and a threat severity indicator. In a second level transmission, an information packet may include video and sound from cameras 80 and 82, and an update of the threat severity indicator. In a level three transmission, the information packet may include video and audio from cameras 80 and 82, an updated threat severity indicator, an indication that the device is firing and that an assault is in progress, and a call for law enforcement assistance.

The wireless communication link provides several advantages in the overall functioning of the personal defense device. Information concerning the attack is recorded, regardless of the outcome of the attack, and may be used at a later time for evaluation and/or in connection with legal issues. Because the information is transmitted in near real-time, the attacker is unable to prevent its transmission or destroy the recorded information. Furthermore, the fact that an attack is being recorded may have a deterrent effect on the attacker. Finally, the transmitted information may be used to initiate a call for law enforcement assistance at the earliest possible time.

Figure 12:
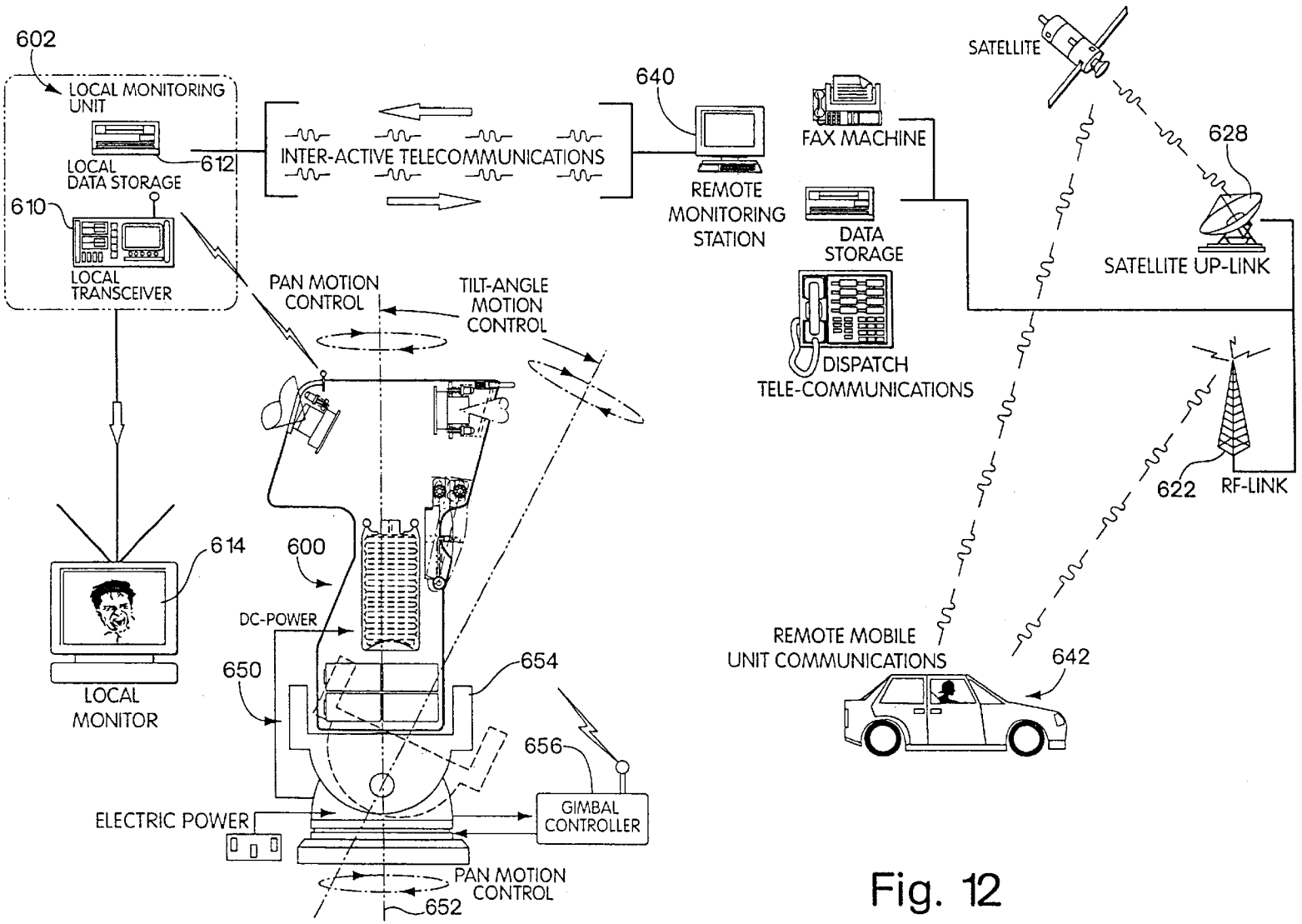
FIG. 12 is a schematic diagram of an embodiment of a communication system incorporating a non-lethal personal defense device in a controllable mounting mechanism.

The personal defense device of the present invention is typically carried by a user at times when a possible threat is perceived. In an alternate configuration or when the device is not being carried by the user, the personal defense device can be mounted in a gimbal assembly as shown in FIG. 12. Personal defense device 600 is mounted in a gimbal assembly 650. The gimbal assembly 650 may permit the personal defense device 600 to be rotated about an axis 652 and to be tilted. Gimbal assembly 650 may include a gimbal mechanism 654 and a gimbal controller 656 having a wireless communication link to local monitoring unit 602. The gimbal assembly 650 may include actuators for remotely controlling the rotational position and angle of personal defense device 600. The personal defense device 600 and gimbal assembly 650 may be mounted in a strategic area, such as an entrance to a home or a business. The system can be programmed to track a moving object and to fire an aerosol plume if necessary. The gimbal assembly 650 and personal defense device 600 can be programmed for automatic operation or for remote control from local monitoring unit 602 or remote monitoring station 640 (FIG. 11).

In one example, the personal defense device can be set to activate and transmit video and audio data when motion is detected in the area. A security provider can view the potential threat and determine the most appropriate action, such as firing the device at the threat, dispatching law enforcement assistance, or notifying the owner. The potential threat can also be viewed at the local monitoring unit 602 to determine the nature of the threat, possibly preventing an innocent person from being fired upon. It will be understood that a variety of different operational protocols can be developed within the scope of the invention.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A security system, comprising:

a personal defense device including:

a housing;

a nozzle having a discharge orifice;

a control valve coupled to said nozzle;

a pressurized source containing a bio-active agent and coupled to said nozzle;

a rangefinder for determining a range to a target;

a trigger mechanism for activating firing of the device; and a firing controller responsive to activation of said trigger mechanism and to the range to the target determined by said rangefinder for operating said control valve to discharge an aerosol plume of the bio-active agent through said nozzle;

a gimbal assembly for mounting said personal defense device in a selected location, said gimbal assembly including means for rotating and tilting said personal defense device; and a monitoring station for controlling said gimbal assembly and said personal defense device.

2. A security system as defined in claim 1, further comprising a wireless communication link for communication between the personal defense device, the gimbal assembly and the monitoring station.

3. A security system as defined in claim 2, wherein said monitoring station includes means for firing the personal defense device.

4. A security system as defined in claim 3, wherein said personal defense device includes a camera for obtaining an image of a target and wherein said monitoring station includes means responsive to the image of the target for controlling the gimbal assembly to track the target.

5. A security system as defined in claim 1, wherein said nozzle is configured for discharging a pulsed mist aerosol plume when the range to the target is relatively short and for discharging a pulsed spray aerosol plume when the range to the target is relatively long.

* * * * *